US008056479B2

(12) United States Patent
Lee et al.

(10) Patent No.: US 8,056,479 B2
(45) Date of Patent: Nov. 15, 2011

(54) SEPARATION DEVICE OF EJECTOR MOTOR FOR PORTABLE MISSILE

(75) Inventors: Hyo-Nam Lee, Daejeon (KR); Jong-Yun Oh, Daejeon (KR); Seong-Eun Kim, Daejeon (KR)

(73) Assignee: Agency for Defense Development, Daejeon (KR)

( * ) Notice: Subject to any disclaimer, the term of this patent is extended or adjusted under 35 U.S.C. 154(b) by 99 days.

(21) Appl. No.: 12/749,710

(22) Filed: Mar. 30, 2010

(65) Prior Publication Data

US 2011/0048267 A1 Mar. 3, 2011

(30) Foreign Application Priority Data

Sep. 3, 2009 (KR) ..... 10-2009-0083186

(51) Int. Cl.
*F42B 15/10* (2006.01)

(52) U.S. Cl. ..... 102/378; 102/377

(58) Field of Classification Search ..... 102/377, 102/378

See application file for complete search history.

(56) References Cited

U.S. PATENT DOCUMENTS

| | | | | | |
|---|---|---|---|---|---|
| 3,760,730 | A * | 9/1973 | Osborne et al. | ..... | 102/377 |
| 3,771,455 | A * | 11/1973 | Haas | ..... | 102/377 |
| 4,745,861 | A * | 5/1988 | Fenton et al. | ..... | 102/377 |
| 5,400,713 | A * | 3/1995 | Humiston et al. | ..... | 102/378 |
| 2011/0048267 | A1 * | 3/2011 | Lee et al. | ..... | 102/378 |

* cited by examiner

*Primary Examiner* — Michael Carone
*Assistant Examiner* — Daniel Troy
(74) *Attorney, Agent, or Firm* — Scully, Scott, Murphy & Presser, P.C.

(57) ABSTRACT

Disclosed is a separation device of an ejector motor for a portable missile, capable of being separated from a missile without any additional separation devices after ejecting the missile. An ejection rocket motor and a separation device are integrally formed. Ejection is performed by a thrust generated while the ejection rocket motor is combusted, and separation is performed by cutting off shearing bolts with using a force generated from a separation cylinder when the combustion of the ejection rocket motor has been completed. This operation and configuration may minimize a weight and a space occupied by a general ejection and separation device in a missile system.

7 Claims, 3 Drawing Sheets

SEPARATION DEVICE OF EJECTOR MOTOR FOR PORTABLE MISSILE

CROSS-REFERENCE TO A RELATED APPLICATION

Pursuant to 35 U.S.C. §119(a), this application claims the benefit of earlier filing date and right of priority to Korean Application 10-2009-0083186, filed on Sep. 3, 2009, the content of which is incorporated by reference herein in its entirety.

BACKGROUND OF THE INVENTION

1. Field of the Invention

The present invention relates to a separable ejection device, and particularly, to a separation device of an ejector motor for a portable missile.

2. Background of the Invention

In general, a tactical missile is mounted inside a lunch tube and comes out of it according to a firing signal. Especially in a man-portable missile, exhaust plume of a rocket motor can hurt a gunner during the firing process, due to a short distance between the man-portable missile and the gunner. To eliminate the possibility, it is conventional to ignite the rocket motor after the missile is ejected and moved to a fixed distance away from the launch tube. The recent trend is to use a small rocket motor for this purpose since it is the simplest method to reduce a recoil force by ejection. The ejection rocket motor should be firmly attached to the missile before the missile is fired. However, it is desirable from the missile weight point of view to separate the ejection rocket motor from the missile after the ejection is completed.

It is a usual way to employ separate devices for the purpose of separation o the ejection system from the missile. The PAD (Propellant Actuated Device) is a typical example of the separation system. The device moves the separation piston using high pressure gas generated by burning a gunpowder or propellant. This device is not only expensive due to its very complicated structure, but also needs separate (additional) gunpowder and ignition system. There is another example of separation device which uses mechanical components. This kind of separation device consists of several components which joins the missile and the ejection system together. There components have the missile separate from the ejection system by mechanically interfering with the launch tube. This method is very simple in a structure, but can give a gunner an excessive impulsive shock.

SUMMARY OF THE INVENTION

Therefore, an object of the present invention is to provide a separation device of an ejector motor for a portable missile, capable of having a simplified structure, and capable of ejecting a missile and then being separated from the missile without any additional separation devices.

To achieve these and other advantages and in accordance with the purpose of the present invention, as embodied and broadly described herein, there is provided a separation device of an ejector motor for a portable missile, comprising: a device fixing unit configured to be fixed to a rear end of the missile by shearing bolts; a frame unit having external and internal combustion pipes concentric with each other, wherein an ignition system is mounted to the inner combustion pipe, and a combustion chamber and a nozzle for discharging combustion gas generated from the combustion chamber therethrough are disposed at a space between the external and inner combustion pipes; and a piston unit having a piston installed so as to perform a relative motion with respect to the frame unit, and configured to provide an external force for cutting off the shearing bolts by a pressure generated by a part of the combustion gas.

The inner combustion pipe may include a first hole configured to communicate an ignition chamber where the ignition system is installed, with the combustion chamber; and a second hole configured to communicate the combustion chamber with the piston unit.

The second hole may be formed in a size large enough for the combustion gas flowed into the piston unit to backflow to the combustion chamber when the combustion gas inside the combustion chamber is exhausted, with time delay long enough to provide a minimum external force necessary to cut off the shearing bolts.

A barrier wall configured to partition the ignition chamber and the piston unit from each other may be formed between the first and second holes.

The device fixing unit may include a connection ring inserted into a rear end of the missile, fixed to the shearing bolts disposed in a radial direction, and having an end more protruding than a rear end surface of the missile; a supporting member fixed to a front end of the external combustion pipe, and disposed between the rear end surface of the missile and the end of the connection ring; and a spring compression-supported between the end of the connection ring and the supporting member, and configured to provide an elastic force to the frame unit toward the missile.

The nozzle may be implemented as multiple nozzles installed in a circumferential direction.

The piston unit may include a cylinder portion formed on an inner circumferential surface of the inner combustion pipe such that the piston performs a relative motion, and communicated with the second hole; and a motion restriction ring disposed on a front end of the cylinder portion, and configured to restrict an additional motion of the moved piston.

The separation device of an ejector motor for a portable missile may have the following advantages.

Firstly, the separation device of an ejector motor for a portable missile according to the present invention may execute both an ejection function and a separation function without any additional separation devices. According to the present invention, an outer part may consist of an ejection rocket motor, and an inner part may consist of components required for separation. Accordingly, a weight and space occupied by a general ejection/separation device in a missile system may be reduced.

Secondly, owing to a connection structure using a spring between the missile and the separation device, the shearing bolts may be prevented from being cut off at the environmental conditions such as unanticipated shock or drop.

Thirdly, since a length of exhaust plume may be reduced by adopting the multiple nozzles, the missile may be ejected even in a small indoor room.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Hereinafter, a separation device of an ejector motor for a portable missile according to the present invention will be explained in more detail with reference to the attached drawings.

A distinguishing characteristic of this invention is that ejection and separation can be performed with an one-body device by selecting a unique ring shape structure. The outer part consist of an ejection rocket motor, and the inner part consist of a separation system using a piston and a separation cylinder. The ejection of a missile is performed by a thrust generated by the rocket motor, and the separation is performed by cutting off shearing bolts using a force generated by the separation cylinder when the rocket motor is burned completely. These kinds of operation method and structure allow a volume and weight of the separation device to be minimized.

Figure 1:
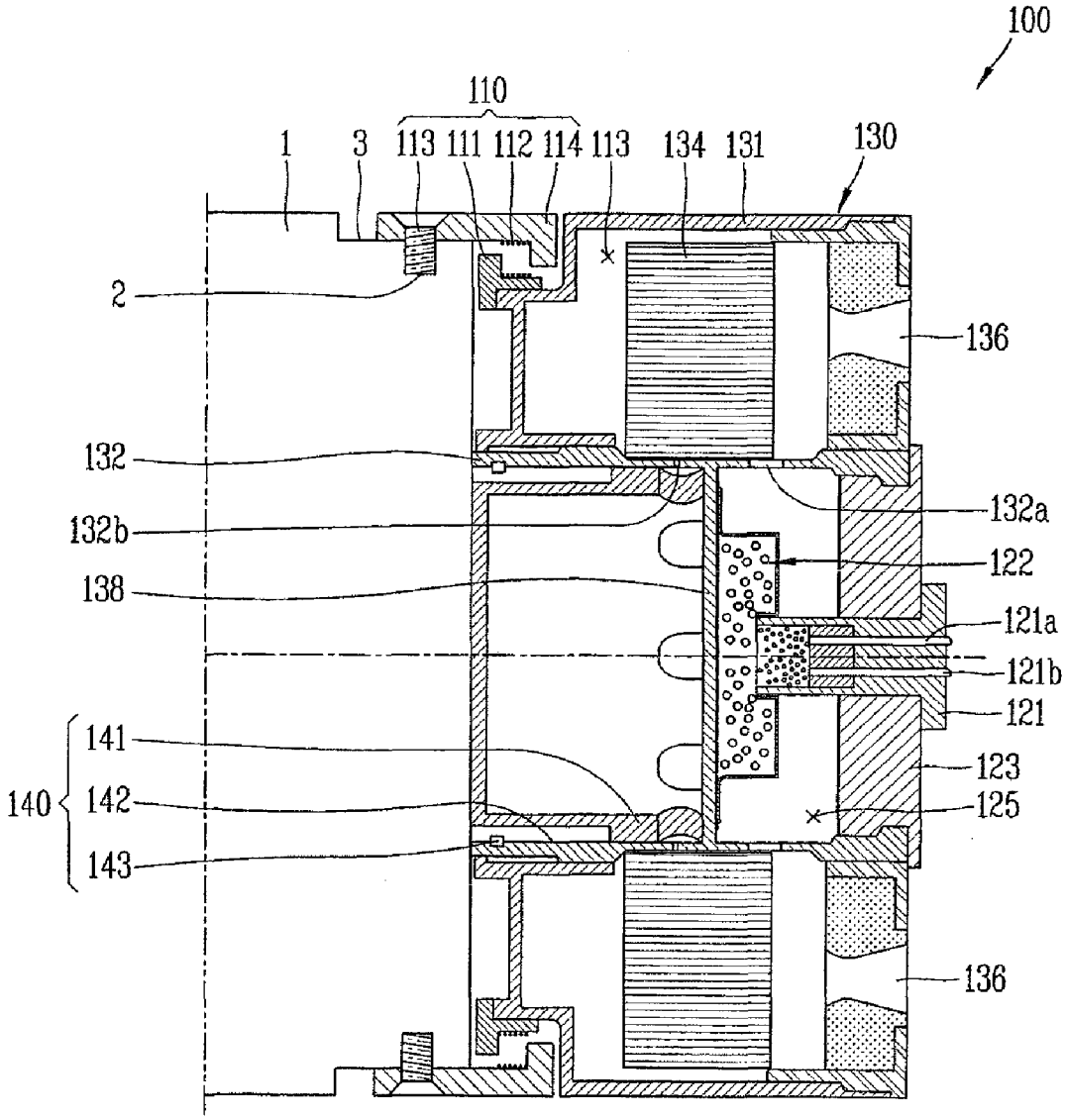
FIG. 1 is a sectional view showing a detailed configuration of a separation device of an ejector motor for a portable missile according to the present invention.

FIG. 1 is a sectional view showing a detailed configuration of a separation device of an ejector motor for a portable missile according to the present invention.

Referring to FIG. 1, the separation device 100 of an ejector motor for a portable missile according to the present invention comprises: a device fixing unit 110 configured to fix the separation device 100 to a missile 1; a frame unit 130 configured to generate a thrust for ejection; and a piston unit 140 configured to provide a force to separate the separation device 100 from the missile 1.

The device fixing unit 110 is mounted to a rear end 3 of the missile 1 by a plurality of shearing bolts 113, and includes a connection ring 114, a supporting member 111, a spring 112, etc.

The connection ring 114 is inserted into the rear end of the missile 1, thus to be fixed by the shearing bolts 113 disposed in a radial direction. When the connection ring 114 receives an external force in a shaft direction of the missile 1, a cutting force is applied to the shearing bolts 113. If the cutting force applied to the shearing bolts 113 is more than a predetermine value, the shearing bolts 113 are cut off, thereby separating the connection ring 114 from the missile 1.

The end of the connection ring 114 is more protruding than a rear end surface of the missile 1, thereby providing a mounting space of the spring 112. The supporting member 111 is disposed between the rear end surface of the missile 1 and the end of the connection ring 114. The supporting member 111 is fixed to a front end of the external combustion pipe 131 that will be later explained.

The spring 112 is compression-supported between the end of the connection ring 114 and the supporting member 111, and is configured to provide an elastic force to the frame unit 130 toward the missile 1. This provides a clearance for aligning a screw hole 2 of the missile 1 and a screw hole of the connection ring 114, and always pushes the separation device 100 toward the missile 1. Accordingly, the shearing bolts 113 are prevented from being cut off by an external impact or drop, etc.

The frame unit 130 includes an external combustion pipe 131 and an internal combustion pipe 132 concentric with each other. A combustion chamber 135 is formed at a space between the external combustion pipe 131 and the internal combustion pipe 132, and a propellant 134 is installed in the combustion pipe 135. A nozzle 136 for discharging combustion gas generated from the combustion chamber 135 is disposed at a rear end of the combustion chamber 135. The nozzle 136 may be implemented as multiple nozzles disposed in a circumferential direction. Since these multiple nozzles can more reduce a length of exhaust plume than a single nozzle, the missile can be ejected even in a small indoor room in the separation device using these multiple nozzles.

An ignition system including an initiator 121 and an igniter 122 is installed at the internal combustion pipe 132.

The piston unit 140 is mounted on a front end of the internal combustion pipe 132. The piston unit 140 includes a piston 141, and a cylinder portion 142 formed on an inner circumferential surface of the inner combustion pipe 132 such that the piston 141 performs a relative motion with respect to the cylinder portion 142. And, the piston unit 140 is configured to provide an external force for cutting off the shearing bolts 113 by a pressure generated by a part of the combustion gas. The cylinder portion 142, and an ignition chamber 125 for mounting the ignition system are partitioned from each other by a partition wall 138.

Once a power source for ignition is applied to connection cables 121*a* and 121*b*, the initiator 121 and the igniter 122 are activated. Ignition gas is flowed into the combustion chamber 135 via a first hole 132*a* which communicates the ignition chamber 125 and the combustion chamber 135 with each other, thereby igniting and combusting the propellant 134. When combustion gas generated from the propellant 134 is discharged through the nozzle 136, a thrust is generated to push the missile 1 forward. During this process, a part of gas generated from the combustion chamber 135 is flowed into the piston unit 140 to form a pressure. By this pressure, the shearing bolts 113 are cut-off to separate the separation device 100 from the missile 1.

The first characteristic of the present invention is how a cutting force for cutting off the shearing bolts 113 is attained and when the separation occurs. The cutting force is obtained by a part of the combustion gas flowed into a space 139 between the piston 141 and the partition wall 138 through the second hole 132*b* which connects the combustion chamber 135 of the internal combustion pipe 132 with the cylinder portion 142. That is, an additional propellant or gunpowder is not required. The inflow gas forms a pressure, thereby generating a force which causes a relative motion between the piston 141 and the cylinder portion 142. The magnitude of the force is controlled by changing a cross-sectional area of the cylinder portion 142. During the combustion of the ejection rocket motor, i.e., the propellant 134, the force pushing the cylinder portion 142 backward is counterbalanced by the rocket thrust and is not sufficient to cut off the shearing bolts 113. For this purpose, the piston 141 is in contact with the end of the cylinder portion 142. However, the rocket thrust is sharply decreasing at the end of the combustion of the propellant 134, the force balance is broken.

Figure 2:
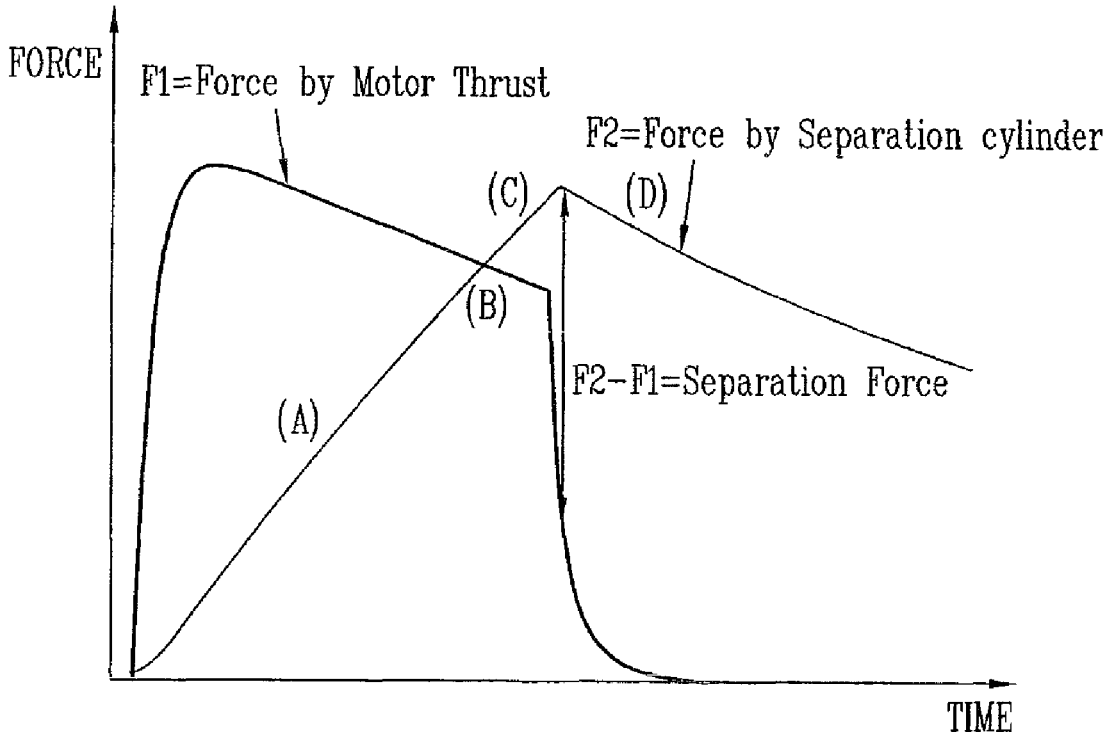
FIG. 2 is a graph showing a principle of cutting off shearing bolts and separating the separation device from a missile.

FIG. 2 is a graph showing a principle of cutting off the shearing bolts and separating the separation device from the missile, which represents the force variation with time. The force F1 is a thrust generated by combustion of the ejection rocket motor, i.e., the propellant 134, and the force F2 is generated by the piston unit 140. The two forces are opposite in the direction. Since the piston 141 is in contact with the rear end of the missile 1, the force F2 acts to the direction of cutting off the shearing bolts 113 by backward pushing the separation cylinder. During the combustion of the propellant 134, the force F2 increases slowly due to the small inflow of combustion gas through the second hole 132*b* and is less than the force F1 (A). Thus, the force F2 is counterbalanced by the force F1, and the relative motion for cutting off the shearing bolts 113 does not occur. As the pressure is increased at the space 139 between the piston 141 and the partition wall 138 according to more inflow of combustion gas, the force F2 becomes equal to the force F1 (B) and, beyond the point, the force F2 becomes greater than the force F1 (C). But, the shearing bolts 113 are not cut off immediately because the force difference between F1 and F1 is not enough to cut off the shearing bolts 113. At the end of combustion of the propellant 134, the thrust F1 decreases sharply, but the force F2 decreases slowly due to the fact that it takes time to decrease the pressure through the second hole 132*b*. As a result, the force balance is broken. That is, when the difference between the two forces (F2−F1) sharply increases due to the sharp decrease of the thrust, the shearing bolts 113 are cut off and the relative motion is performed. This means the separation of the missile 1 from the separation device 100. The second hole 132*b* which satisfies the condition may be formed in a size large enough for the combustion gas flowed into the piston unit 140 to backflow to the combustion chamber 135 when the combustion gas inside the combustion chamber 135 is exhausted, with time delay long enough to provide a minimum external force necessary to cut off the shearing bolts 113.

Figure 3:
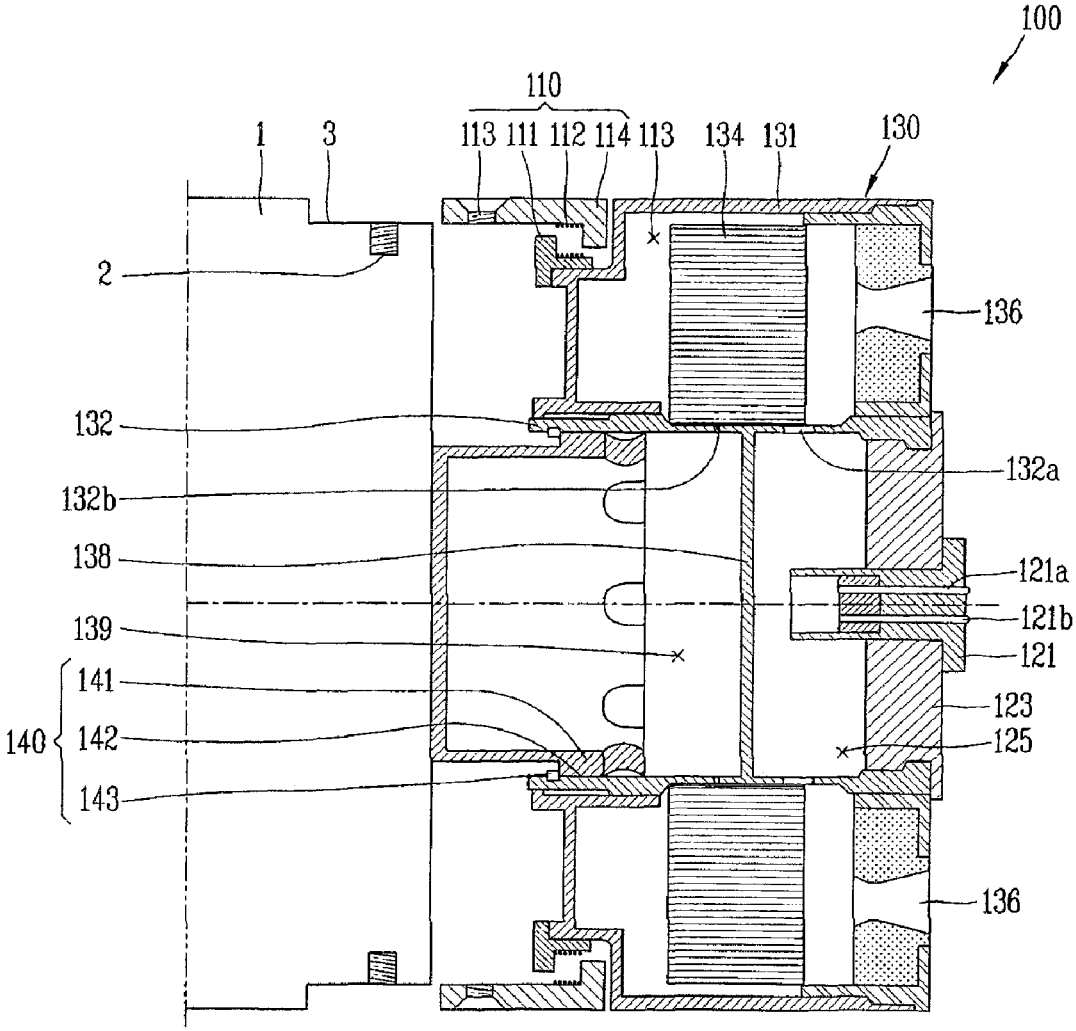
FIG. 3 is a view showing a status of the separation device of an ejector motor for a portable missile of FIG. 1 after separation.

FIG. 3 is a view showing a status of the separation device of an ejector motor for a portable missile of FIG. 1 after separation. Due to the relative motion of the piston 141 and the cylinder portion 142, the shearing bolts 113 are cut off and separated from the missile.

The moment of the separation is very important in this kind of system. When the separation occurs during the combustion of the ejection rocket motor, i.e., the propellant 134, the rocket thrust may not be completely transferred to the missile 1. Therefore, the separation should occur after the completion of the combustion. This invention satisfies the condition perfectly.

A motion restriction ring 143 is installed at a front end of the cylinder portion 142 so as to restrict additional motion of the moved piston 141. That is, the separation device 100 of the present invention is not scattered into several bodies, but separated to one body after the completion of the separation. The relative motion of the piston 141 and the cylinder potion 142 is constrained by the motion restriction ring 143. The motion restriction ring 143 serves to prevent the piston 141 from being separated from the cylinder portion 142 by the relative motion, thereby separating the piston 141 from the separation device 100 as one body.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A separation device of an ejector motor for a portable missile, configured to be separated from a missile after ejecting the missile to a predetermined distance from a gunner, the device comprising:

a device fixing unit configured to be fixed to a rear end of the missile by shearing bolts;

a frame unit having external and internal combustion pipes concentric with each other, wherein an ignition system is mounted to the inner combustion pipe, and a combustion chamber and a nozzle for discharging combustion gas generated from the combustion chamber therethrough are disposed at a space between the external and inner combustion pipes; and a piston unit having a piston installed so as to perform a relative motion with respect to the frame unit, and configured to provide an external force for cutting off the shearing bolts by a pressure generated by a part of the combustion gas.

2. The device of claim 1, wherein the inner combustion pipe comprises:

a first hole configured to communicate an ignition chamber where the ignition system is installed, with the combustion chamber; and a second hole configured to communicate the combustion chamber with the piston unit.

3. The device of claim 2, wherein the second hole is formed in a size large enough for the combustion gas flowed into the piston unit to backflow to the combustion chamber when the combustion gas inside the combustion chamber is exhausted, with time delay long enough to provide a minimum external force necessary to cut off the shearing bolts.

4. The device of claim 2, wherein a barrier wall configured to partition the ignition chamber and the piston unit from each other is formed between the first and second holes.

5. The device of one of claims 1 to 4, wherein the device fixing unit comprises:

a connection ring inserted into a rear end of the missile, fixed to the shearing bolts disposed in a radial direction, and having an end more protruding than the rear end of the missile;

a supporting member fixed to a front end of the external combustion pipe, and disposed between the rear end surface of the missile and the end of the connection ring; and a spring compression-supported between the end of the connection ring and the supporting member, and configured to provide an elastic force to the frame unit toward the missile.

6. The device of claim 4, wherein the nozzle is implemented as multiple nozzles installed in a circumferential direction.

7. The device of claim 2, wherein the piston unit comprises:

a cylinder portion formed on an inner circumferential surface of the inner combustion pipe such that the piston performs a relative motion, and communicated with the second hole; and a motion restriction ring disposed on a front end of the cylinder portion, and configured to restrict an additional motion of the moved piston.

* * * * *